United States Patent [19]

Russell

[11] Patent Number: 4,892,292

[45] Date of Patent: Jan. 9, 1990

[54] NON-CORROSIVE SECURITY RAILING

[75] Inventor: Thomas R. Russell, Miami, Fla.

[73] Assignee: Saftron Inc., Miami, Fla.

[21] Appl. No.: 862,252

[22] Filed: May 12, 1986

[51] Int. Cl.[4] ..... E04H 17/14

[52] U.S. Cl. ..... 256/66; 256/65; 256/19

[58] Field of Search ..... 256/65, 66, 19, 59, 256/24, 25, 29, 30, 73, 1; 403/26.5

[56] References Cited

U.S. PATENT DOCUMENTS

| | | | |
|---|---|---|---|
| 569,235 | 10/1896 | Rockwell | 403/265 |
| 1,411,229 | 3/1922 | Thomas | 403/265 |
| 2,614,827 | 10/1952 | Peach et al. | 256/65 X |
| 3,107,900 | 10/1963 | De Paolo | 256/65 |
| 3,284,113 | 11/1966 | Howell | 403/265 X |
| 3,787,033 | 1/1974 | Snyder et al. | 256/59 |
| 3,859,408 | 1/1975 | Voss et al. . | |
| 3,933,311 | 1/1976 | Lemelson | 256/1 |
| 3,940,114 | 2/1976 | Rivelli | 256/32 |
| 4,053,140 | 10/1977 | Clemens et al. | 256/19 X |
| 4,168,054 | 9/1979 | Weiland | 256/73 |
| 4,181,764 | 1/1980 | Totten | 256/19 X |
| 4,461,461 | 7/1984 | Caron | 256/19 |
| 4,477,059 | 10/1984 | Willis | 256/65 |
| 4,508,321 | 4/1985 | Marimoto | 256/65 |
| 4,557,467 | 12/1985 | Lin | 256/1 |
| 4,610,432 | 9/1986 | Lewis et al. | 256/1 |

FOREIGN PATENT DOCUMENTS

| | | | |
|---|---|---|---|
| 1475039 | 2/1967 | France | 256/65 |
| 393697 | 6/1933 | United Kingdom | 256/65 |
| 1443057 | 7/1976 | United Kingdom | 256/19 |

*Primary Examiner*—Andrew V. Kundrat
*Attorney, Agent, or Firm*—Fred Philpitt

[57] ABSTRACT

A security railing formed from plastics material pipe which is lightweight, low cost, and non-corrosive. The top railing and preferably the posts of the security railing are formed of double pipe construction comprising a first pipe and a second pipe inside the first pipe, the second pipe having an outside diameter related to the inside diameter of the first pipe. The first pipe is of plastics material and the second pipe preferably also is of plastics material. A lower railing utilizes a plastic pipe having the same outside diameter as the laminated top railing. T connectors and cross connectors are used at the joints between the upper and lower railings and the posts, and these T connectors and cross connectors are of the same outer dimension as the first pipe to give the railing a smooth contour. A plurality of holes in the lower surface of the upper railing and the upper surface of the lower railing permit the insertion of smaller diameter plastics pipe sections at closely spaced intervals to provide vertical railing elements. The security railing meets requirements of national building codes and will not permanently deform under test loads. The plastics material used is preferably polyvinyl chloride.

14 Claims, 6 Drawing Sheets

NON-CORROSIVE SECURITY RAILING

BACKGROUND OF THE INVENTION

1. Field of the Invention

The present invention relates to security railings for balconies, stairs, and the like and more particularly to a railing of which at least the outer surface which is exposed to the elements is of plastics material, and which will meet building codes.

With the present trend toward multistory condominium and apartment buildings having balconies, there is a need for a security railing formed at least on the surface exposed to the elements, from non-corrosive materials. It has been found that metallic security railings which have been constructed from iron, steel, aluminium or the like have a short life in buildings exposed to polluted air and for buildings in coastal areas exposed to the corrosive effect of the salt water atmosphere. To maintain such metallic security railings in safe condition, continuous maintenance is required for removing rust and corrosion, and for refinishing of the railings. Where such maintenance is neglected, such railings can quickly become unsafe and dangerous.

2. Description of Related Art

There have been attempts in the prior art to develop reinforced non-metallic structures suitable for railings. For example, in U.S. Pat. No. 4,181,764 to Totten, a rail is disclosed having a wooden core with a weather and abrasion resistant outer coating. However, a plurality of valve means must be provided for releasing vapour from the core yet preventing passage of water into the core. Furthermore, the strength of the Totten rail is determined by the wood core. To obtain the necessary strength for a building security railing, it is considered that the resulting structure would be too bulky and unattractive. Murphy in U.S. Pat. No. 3,957,250 teaches a fence post fabricated from tubular plastic material and filled with semi-rigid or rigid foam for additional strength. However, the posts appear to be suitable only for stringing of wire fencing. The U.S. Pat. No. 4,053,140 to Clemens, et al shows a non-corrosive plastic handrail system designed for use in industrial applications along stairways, platforms, and the like to eliminate the corrosion problems due to electric currents and fields as well as corrosive environments. The strength of the handrail system described depends upon the use of a special thermosetting resin in which high tensile strength reinforcing fibres have been incorporated as taught by U.S. Pat. No. 3,859,409. Such specialised material is expensive and the patent does not disclose any testing of strength to determine if the material would satisfy building codes for balcony railings in apartment buildings and the like.

It has furthermore been proposed in U.S. Pat. No. 4,461,461 to Lee Caron to provide a security railing formed entirely from polyvinyl chloride pipe having a novel laminated structure which has the advantages of being lightweight, low cost, and non-corrosive. The railing disclosed in said Caron patent will withstand significant deformation yet will return to its original shape when the load is removed.

In the Caron patent a balcony railing or the like is constructed which has a normal appearance. For example, there is a plurality of upright posts which may be attached to the building floor in any conventional manner such as by flanges, anchoring in the concrete, or the like. It is preferred to anchor a steel pipe or bar into a concrete deck with the post placed over the pipe. A top rail is provided coupled to the vertical posts by suitable T or cross couplings. Similarly, a lower rail is provided coupled to the vertical posts by cross couplings. Disposed between the upper and lower posts is a plurality of smaller rail elements closely spaced in a conventional pattern.

In accordance with the Caron invention, the top rail sections and the vertical posts are formed by laminating two polyvinyl chloride (PVC) pipes. For example, the outside pipe may be a schedule 40 PVC pipe having a nominal 1½ inch diameter which is actually 1.99 outside diameter and 1.66 inside diameter. An inner PVC pipe formed from schedule 80 PVC is inserted through the outer pipe. The outer diameter of the inside pipe is 1.66 inches and the inside diameter 1.278 inches. As may be recognized, the inside pipe forms a snug fit into the outside pipe to thereby form a laminated rail having both strength and flexibility. It may be seen that a load placed on the laminated rail will cause a deflection and the inner pipe may move relative to the outer pipe to prevent excessive stress at the point of load, yet the combination provides the required strength.

In addition to the laminated construction of the top rail, Caron proposes that similar laminated PVC pipes be utilised for the posts. He suggests that the lower rail does not require lamination although he states that it will be obvious that the laminated rail may also be used as the lower rail. Otherwise, schedule 40 1½ inch PVC pipe may be used.

The vertical elements between the posts may be ½ inch diameter schedule 80 PVC pipes spaced about 6 and installed in holes drilled along the top and bottom rails. It has been found that a spacing of posts of about 4 feet provides the required strength.

The PVC pipe utilized to form the rails may be obtained in a variety of finishes and colours. Thus, the security railing can be made very attractive and requires essentially no maintenance.

A typical railing section disclosed by Caron was tested under Southern Building Code, Section 1204, Special Load 1204.2-Railing. The railing was anchored in concrete in a horizontal position. The railing was loaded to 50 pounds per linear foot and withstood the load with a maximum downward deflection of 6 inches. After removing the load, the railing assumed its original shape with no permanent deformation. The testing laboratory reported that the security railing met the applicable code specifications.

The strength and safety features of the Caron railing is further shown by a report from the testing laboratory which noted that during the 50 pound per linear foot load test, the anchoring of the jig used failed. This caused a 1600 pound load to be catapulted unto the railing. The laboratory reported that the railing received the entire weight of this load along the full length of the rail about the midsection thereof. This excessive load bent the rail at approximately a 40° angle but with no structural damage thereto. Once the load was removed, the railing sprung back to its original shape.

SUMMARY OF THE INVENTION

The present invention comprises a number of novel aspects which have resulted from work conducted on the railing disclosed by Caron, but the railing according to the invention does or should retain the advantages of the Caron railing, such advantages, as outlined above, being considerable.

Thus, the railing of the present invention should retain the qualities of being resistant to corrosion, but it is not necessary that the plastics material should be polyvinyl chloride, although this material is highly preferred. Also, the railing should meet the strength performance of the railing disclosed in the Caron patent.

The Caron patent discloses the use of T connectors and cross connectors into which the top and bottom rails and posts fit, the connectors being sized accordingly. The railing can be improved and is according to a first aspect of this invention, by the use of novel connectors.

In the Caron construction, where the top and bottom rails, and the posts comprises first and second plastics material pipes, the strength thereof can be improved, and is improved according to a second aspect of the invention, by appropriate utilization of novel pipe constructions and assembly.

Another feature of the present invention which modifies the Caron invention comprises a novel method of connecting the laminated top and bottom rails in the region of the connectors.

Yet another feature of the present invention relates to a novel method of splicing the laminated top and bottom rails.

The present invention furthermore includes a device and method whereby improved locking of the vertical elements between the top and bottom rails to prevent malicious or accidental removal of same.

In a further aspect, the present invention discloses that the posts are fitted in the base mounting in a particular and special manner. A considerable departure from the Caron construction resides in yet a further aspect of the invention in that in this aspect the use of a second pipe within a first pipe, or laminated construction, is eliminated, and in this aspect the achievement of railing strength is by another means, and in a preferred construction the use of connectors can be illuminated.

It is therefore a primary object of the invention to provide a security railing for balconies and the like which is low cost, non-corrosive, will meet established building codes, and presents a neat appearance.

It is another object of the invention to provide a security railing formed from plastic pipe in which the main members thereof are formed from laminated plastics pipe of improved strength.

It is yet another object of the invention to provide a plastic pipe security railing in which rail members are connected in rail connectors.

It is still another object of the invention to provide a security railing of which the rails may be spliced together.

It is a further object of the invention to provide rails for a security railing formed from tubular plastic pipe of which the rails are locked together.

These and other objects and advantages of the invention will become apparent from the following detailed description when read in conjunction with the drawings.

DESCRIPTION OF THE PREFERRED EMBODIMENTS

Figure 1:
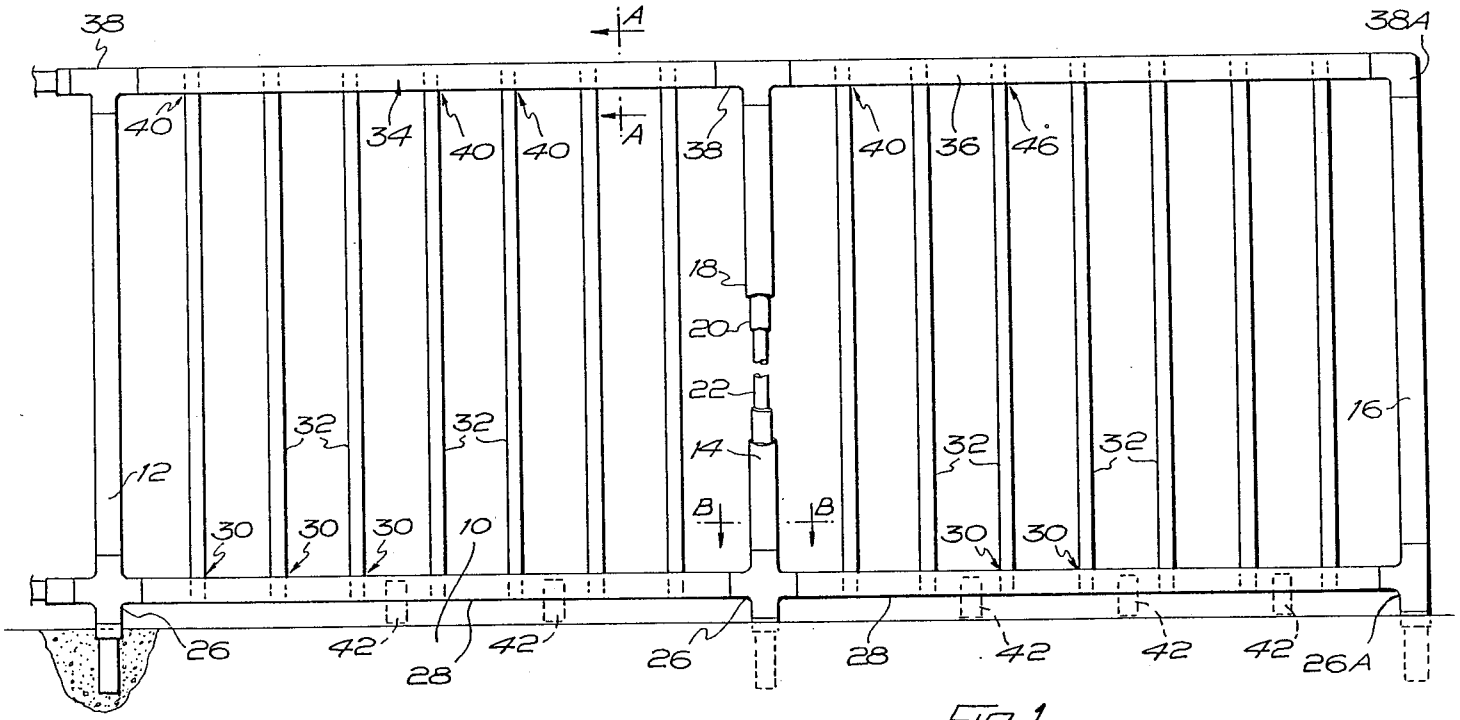
FIG. 1 is an elevation view of a typical security railing in accordance with one aspect of the invention showing details of the construction thereof.

Referring first to FIG. 1, a typical arrangement for a security railing in accordance with the invention is shown. For purposes of illustration, the security railing is shown to be installed on a concrete deck 10 which could be a balcony, porch, patio, or the like. Two sections of the security rail are shown and it is assumed that the railing continues to the left, the right portion being an end section. Three posts 12, 14 and 16 are shown. Each post 12, 14, 16 is formed from an outer pipe 18 formed from plastics material, specifically polyvinyl chloride (PVC) plastic. An inner pipe 20 fits snugly within outer pipe 18 as shown in part cross sectional view in FIG. 2. Outer pipe 18 is preferably formed from schedule 40 PVC pipe and inner pipe 20 is preferably formed from schedule 80 PVC pipe. Pipe 20 forms a snug fit with outer pipe 18 and furthermore the inner and outer pipes are glued together.

Figure 2:
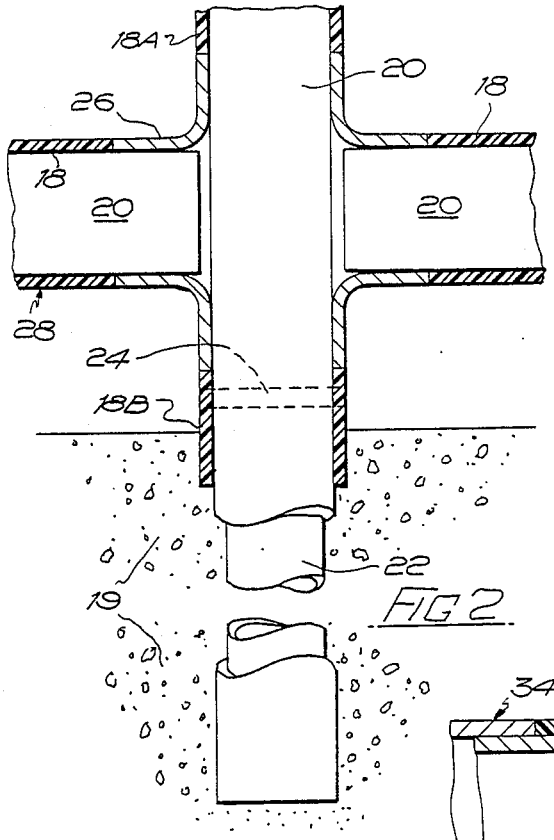
FIG. 2 is a cross sectional detail of a preferred method of attaching the security railing to a deck.

A steel pipe or bar 22 is disposed in concrete slab 10 projecting up to location 17 (FIG. 2) about 1 to 1½ feet above slab 10. The outer diameter of bar 22 is selected to form a tight fit in the inside diameter of inner pipe 20. Thus, when post 12, 14 or 16 is installed it is tapped or driven down over bar 22 until the lower end is embedded in slab 10 as shown in FIG. 2. As indicated in FIG. 2, post 14 and bar 22 can be drilled to accept a PVC pin 24 for additional security. A cross fitting 26 is placed over inner pipe 20 at the distance desired for lower rail 28 above slab 10. The fitting 26 divides outer post 18 into sections 18A and 18B and is of the same diameter as pipe 18 so that its outer surface is a smooth continuation of the pipe sections 18A, 18B giving the railing a smooth clean appearance. The outer posts 12 and 16 in the railing are similarly formed and installed.

The lower rail 28 for the railing sections shown are formed from schedule 40 PVC pipe (with inner pipe 20) having the same size as pipe 18 used for posts 14. A series of holes 30 are provided along the upper side of a typical lower rail section 28 which is of length to span from post 12 to post 14. The ends of lower rail sections 28 fit into fittings 26 as seen in FIG. 2. Holes 30 accept vertical railing elements 32 which are preferably formed from ½ inch diameter schedule 80 PVC pipe. The spacing from centre to centre of railing elements 32 may be of 6 inches.

Figure 4:
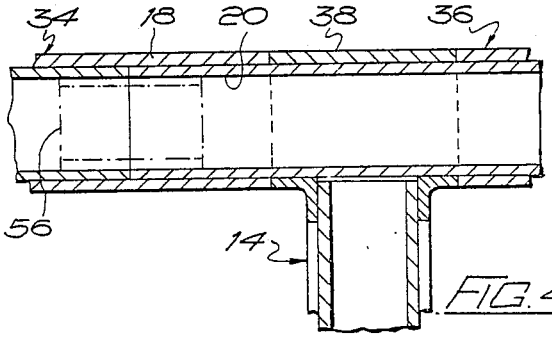
FIG. 4 is a cross sectional view of a laminated railing of the invention.

Top railings 34, 36 and lower railing 28 are fabricated in the same manner as posts 14. In FIG. 1, each top railing 34, 36 may be about 4 feet in length spanning from post 12 to 14 and 14 to 16. As may be seen from FIG. 4, railing 34 has its outer PVC pipe 18 butting against top coupling 38 of post 14. Similarly, the right end of outer pipe 18 of rail railing 36 butts against fitting 38 of post 14. Inner pipe 20 in rail 36, however, starts at the second vertical railing element 32 to the left of post 14 and projects about 1 foot through the fitting 38 of post 14 as shown in FIG. 4. Similarly, inner pipe 20 of railing 34 stops short of fitting 38 as shown. Advantageously, the overlap of the inner pipe 20 with the outer pipes 18 of adjacent railing sections 34, 36 provides additional strength and rigidity in concert with T fittings 38 which are cemented to the posts 14 and the railing sections 34, 36. The underside of railings 34, 36 include holes 40 to accept the upper ends of vertical railing elements 32.

The arrangement shown in FIG. 1 may optionally be provided with auxiliary supports. When a security railing in accordance with the invention is to be installed in a balcony or porch having an overhead ceiling, cross connections 26 may be provided at the top of alternate post such as 12 and 16. Auxiliary posts formed from schedule 40 PVC pipe of the same type used for pipe 18 may be cemented into cross connections 26 and to mounting flanges which are fastened to the overhead ceiling or beam. The auxiliary supports may be extensions of the outer pipe 18 of posts 12, 14, 16. Such auxiliary supports are illustrated and described in said U.S. Pat. No. 4,461,461 incorporated herein by reference.

As shown at the right hand end in FIG. 1, the end of a security railing section may be finished with a right angle connector 38A rather than a connector 38. Other configurations such as right angle railing sections and alternative end sections using readily available PVC pipe fittings will be obvious to those of skill in the art.

Calculations have been made for the configuration of the invention illustrated in FIG. 1. It was assumed a worst case of no vertical railing elements 32 and a load of 50 pounds per foot concentrated into a single force of 200 pounds applied horizontally at the midcentre of between vertical posts 12 and 14 on top rail 34 for an application in which said auxiliary supports are not used. For the top rail section 34 having outside PVC pipe 18 of 1.99 inches in diameter and 1.66 inches inside diameter with inside pipe 20 having an inside diameter of 1.278, the stress in top rail section 10-2 would be approximately 8,955 pounds per square inch. The PVC manufacturer's data shows a flexural strength of 11,000 pounds per square inch for the laminated rail section 14. As discussed hereinabove, actual tests by a testing laboratory have verified these calculations.

The PVC pipe utilized in the preferred embodiment of the invention is readily available at low cost as compared to metallic structures providing the same strength. It is available with a high gloss or a satin type finish, and the material may be pigmented in a variety of colours to suit the building with which the railing may be used. The polyvinyl chloride material is impervious to corrosive atmospheres, salt spray, and other environmental conditions which will quickly damage metal railings. No painting is required and the material is easily cleaned. An embodiment of the invention has been described in relation to FIGS. 1 to 12 in which round, hollow PVC pipes have been utilized. However, PVC may be extruded in square and rectangular shapes as well and such shapes are suitable for practising the invention as illustrated by FIGS. 13 to 19. Similar reference numerals to those used in FIGS. 1 to 12 have been used to illustrate similar parts.

Figure 5:
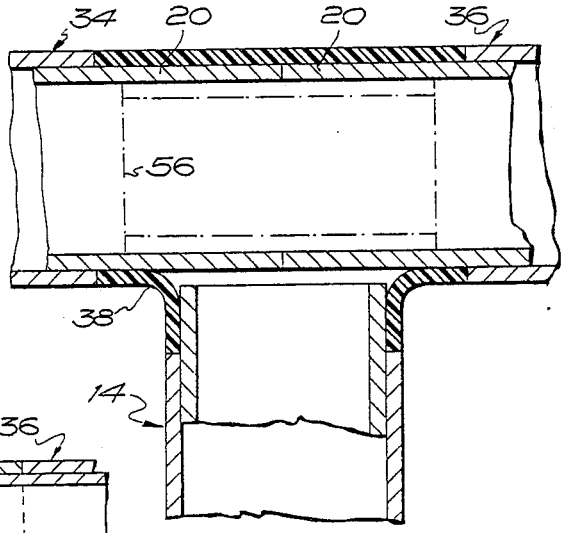
FIG. 5 is a cross sectional view of a modified form of laminated railing.
Figure 5A:
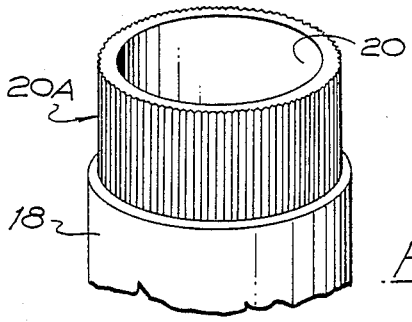
FIG. 5A is a perspective view of part of a laminated railing according to the invention.

Additionally, as shown in FIG. 5A, the outer surface of the inner pipe 20 may have serrations 20A as shown for the reception of cement or glue in order to provide for a more secure cementing or glueing the inner and outer pipes together. Instead or in addition the inner surface of the outer pipe 18 may have serrations.

Also, the outer pipes may be molded to decorative shapes, such as bamboo or the like.

It is to be noted that the fittings 26, 38 receive the inner pipes 20 and the outer pipes abut the fittings 26, 38 and are of tee same outer dimensions to improve the appearance of the railing, keeping the lines clean and neat.

Although a specific design has been disclosed appropriate to the pipe sizes selected, it will be apparent that greater strength may be provided by use of larger and thicker pipe sections, closer spaced posts, and other modifications and variations which will be obvious to those of skill in the art. Such modifications are to be considered within the spirit and scope of the invention.

Further detail of various aspects of the present invention will now be explained with reference to the various Figures of drawings accompanying this application, and referring firstly to FIG. 1, it is to be noted that the cross connectors 26 and the T connectors 38, and the end connectors 26A and 38A are of an outer diameter equal to the outer diameter of outer pipes 18 of the top rails 34 and 36, the bottom rails 28 and the posts 12, 14 and 16, and that the said outer pipes 18 abut the said connectors 26 and 38, giving the railing a smooth and neat appearance in the region of the connectors, which contrasts sharply with the connectors disclosed and utilised in the Caron patent.

A further feature of the present invention is shown in FIG. 1 by the dotted lines 42 which indicate lower feet which prevent the bottom rails 28 from being deflected downwardly towards the surface of the floor 10. Said feet 42 are located in apertures in the bottom rails 28 as indicated.

FIG. 2 illustrates how a cross connector 26 in fact divides the outer pipes 18 of the posts 12, 14 and 16 into upper and lower sections 18A and 18B, and it will be noticed that the lower section 18B in the embodiment of FIG. 2 is in fact embedded in the cement floor 19, but is embedded only a short way into the floor 19, whilst the inner pipe 20 is embedded along with the metal pipe 22 to a much greater extent.

Figure 3:
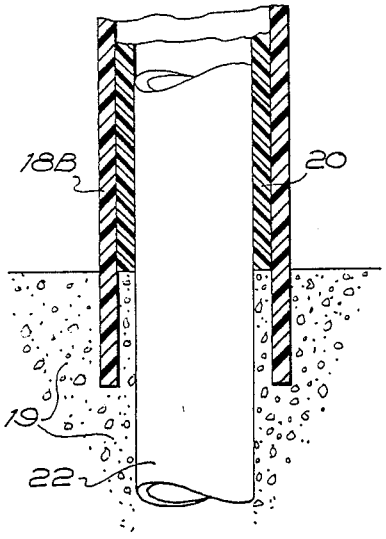
FIG. 3 is a cross sectional detail of a modified form of attaching the railing to a deck.

In the arrangement of FIG. 3 on the other hand, the outer pipe 18B is embedded in the floor 19 as shown to a greater extent, whilst the inner pipe 20 stops at the floor level. This means that portions of the outer pipe 18B which are embedded in the concrete 19 form a skirt, substantially preventing the ingress of water and moisture which collects in the region of the lower end of each post, from coming into contact with the metal pipe 22, whereby problems with the corrosion of the said pipe are obviated or mitigated.

Figure 6:
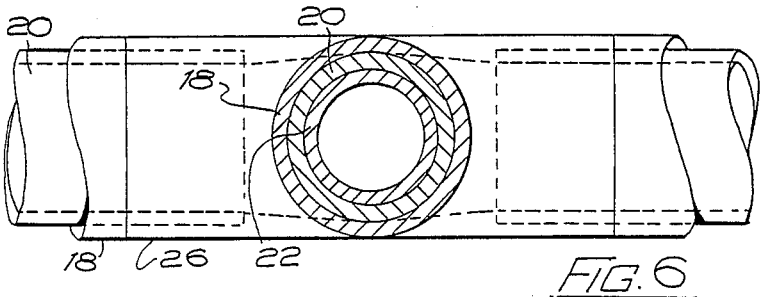
FIG. 6 is a section on the line B—B in FIG. 1.

FIG. 6 illustrates a cross sectional view of the post 14, the section being taken on the line B—B in FIG. 1, and it will be seen that round pipes 18, 20 and 22 are utilised in the arrangement of FIG. 6.

Figure 7:
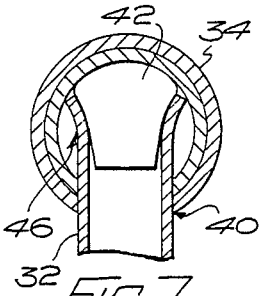
FIG. 7 is a section on the line A—A in FIG. 1.
Figure 8:
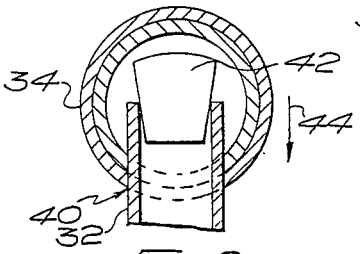
FIG. 8 is a section similar to FIG. 7, but prior to the making of the connection.

FIGS. 7 and 8 show another aspect of the present invention providing a means whereby the top ends of the members 32 may be locked to the upper rails 34, 36.

If reference is made firstly to FIG. 8, it will be seen that when the railing has been assembled, the top end of the member 32 is provided loosely with a wedge block 43 in the form of a truncated cone, and the cone and top end of the member 32 are passed through aperture 40 to a position shown in FIG. 8.

The firm connection referred to is established by forcing the top rail 32 downwards in the direction of arrow 44 in FIG. 8, so as to deform the wedge block 43 and to force same into the top end of member 32 causing same to be splayed or outwardly distorted as indicated at 46 in FIG. 7. It will be appreciated that when the top end of the tube 32 is thus distorted, it cannot be retracted from the top rail 34.

Figure 9:
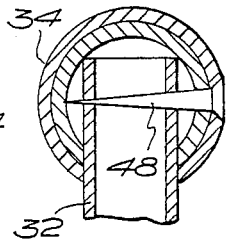
FIG. 9 is a sectional view of an alternative arrangement to that shown in FIG. 7.

FIG. 9 shows an alternative method of connecting the top end of the member 32 to the rail 34. In this case a screw or other fastening member 48 which is driven through the rail 43 and the top of member 32 as shown in FIG. 9, is used. Such a fastening arrangement as shown in FIG. 9 may be used in the case where a rail 32 as connected previously shown in FIG. 7 is removed by sawing or otherwise cutting through the rail at the region of aperture 40 so as to leave only a stump in the inside of the rail 34, such a stump comprising the end of member 32 and a wedge 43, but to displace such a stump from the aperture 40. A member 32 subsequently inserted in substitution of such removed member could be connected for example as shown in FIG. 9.

Figure 10:
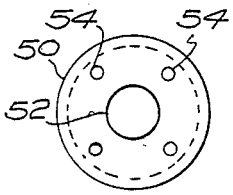
FIG. 10 is a plan view of an end plate useable in the arrangement of FIG. 1.
Figure 11:
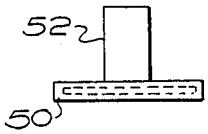
FIG. 11 is a side view of the end plate shown in FIG. 10.

FIGS. 10 and 11 show an end plate which can be used for fixing a free end of a top or bottom rail 34 or 28 to a vertical adjacent wall. The end plate comprises a disc 50 with a stub shaft 52 matched to the interior diameter of the inner pipe 18 of the laminated pipe construction. The stub shaft 52 is located in the end of the inner pipe adjacent the vertical wall, and a plate is secured to the wall by passing screws or other fastening means through apertures 54 provided in said plate 50. It is to be mentiOned that the top rail 34 or 36 when fitted to a vertical wall in this manner will be made to extend to a position as close to the vertical wall as possible so that there is minimum gap between the plate 50 and the end of the top rail 34, when the end plate is in position.

Figure 12:
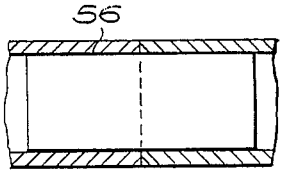
FIG. 12 is a sectional view of a splicing sleeve for use in the arrangement of FIG. 1.

FIG. 12 shows a splice plug 56 which may be a sleeve or solid cylinder of suitable plastics or other material. The splice plug 56 is utilised to bridge the junction where inner pipes 20 of aligned upper or lower rails abut. FIG. 4 shows for example how the splice plug 56 would be located to bridge the joint between the abutting inner pipes 20. The splice plug is cemented in the position shown in FIG. 4 in order to provide a rigidifying effect in the region of the said joint.

It is useful at this point to refer to FIG. 5 which shows a T connector 38 at the top of post 14. The inner pipes 20 of the rails 34 and 36 where they meet in the region of connector 38 have the junction located centrally of the connector as opposed to being offset as indicated in FIG. 4, and again the splice plug 56 is shown as being located to bridge the said junction and also to lie centrally in the top cross bar of the T connector.

Figure 13:
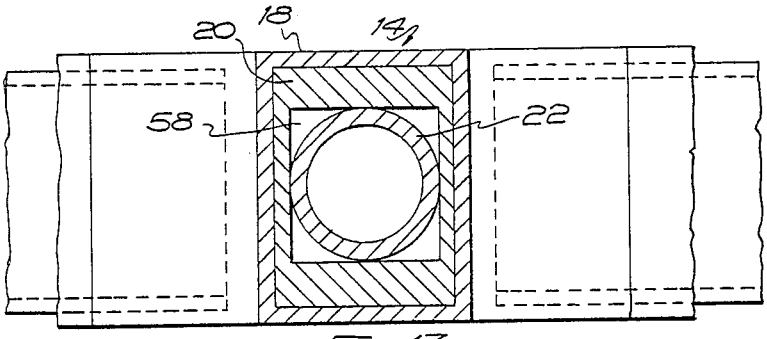
FIGS. 13 to 19 are views similar to FIGS. 16 to 12 but showing a modified arrangement.
Figure 14:
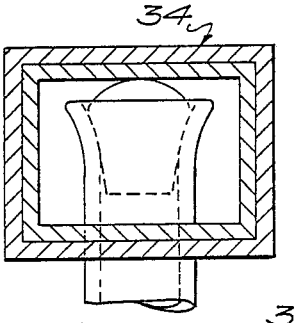
Figure 15:
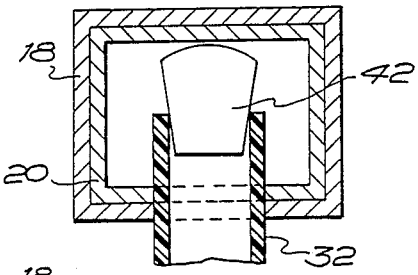
Figure 16:
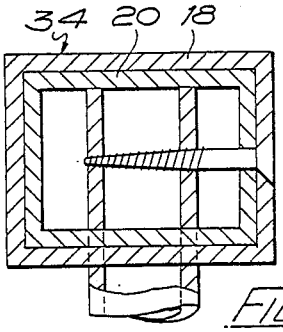

FIGS. 13 to 19 show a rail arrangement in which the inner and outer pipes 18 and 20 are of rectangular construction. The inner pipe 20 of the post, as shown in FIG. 13, is of slightly modified construction insofar as whilst it is of outer rectangular configuration to match the inner configuration of the outer pipe 18, the wall thickness of the inner pipe at the narrower ends of the rectangle is greater than that of the longer sides of the rectangle as this is to provide a square aperture 58 for receiving neatly the metal pipe 22 which is embedded in the concrete floor.

Figure 17:
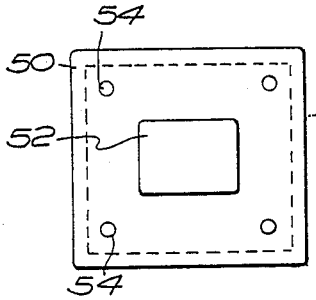
Figure 19:
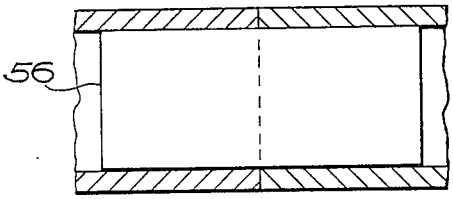
Figure 18:
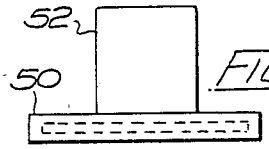

The end plate of FIGS. 17 and 18 has the same features as the end plate of FIGS. 10 and 11 except that the base plate 50 is rectangular, and the stub shaft 52 is rectangular, the dimensions of the plug 52 being related to the inner dimensions of the inner pipe 20. Also, the splice plug 56 is of rectangular configuration so to fit neatly inside the inner pipes 20.

Figure 20:
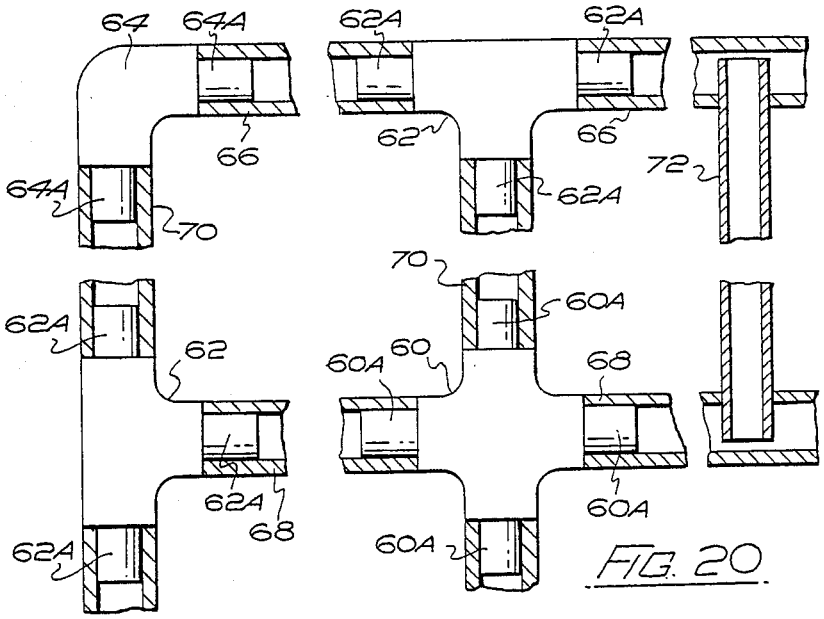
FIG. 20 is a side view of a security railing according to a second aspect of the invention.

A modified form of railing structure is shown in FIG. 20, and this arrangement may use the laminated or double pipe construction top rails, bottom rails and posts as required, or alternatively it may use single tubular construction top rails, bottom rails and posts as required.

The arrangement comprises a series of cross T connectors 60, 62 and corner connectors 64 in the form of bodies having plug ends 60A, 62A and 64A which are received in the ends of the tubular top rails 66, bottom rails 68 and posts 70. The vertical members 72 may be received between the top rails 66 and the bottom rails 68 as shown in FIG. 20, ad is described in more detail in relation to previous figures.

The various plugs 60A, 62A and 64A are cemented in the ends of the top and bottom rails and posts 66, 68 and 70 to give the construction shown clearly in FIG. 20.

Figure 21:
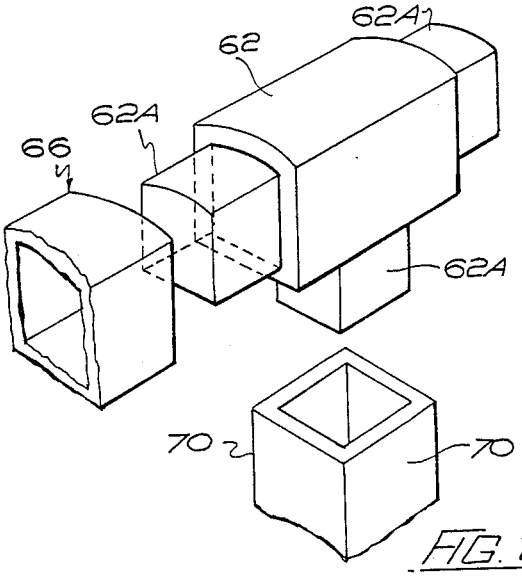
FIG. 21 is an exploded perspective view of a coupling of the railing of FIG. 20.

FIG. 21 shows typically T connector 62 which connects a post 70 where two top rails 66 stop. It will be seen that the connector 62 comprises a solid body of generally square configuration except that the upper surface is convexed, and the plugs 62A are of similar configuration except that they are smaller in dimension, as regards those plugs which extend from the ends of the cross piece of the T connector. The leg of the connector is provided with a plug 62A of square cross section which is received neatly and cemented in the top end of a corresponding section post 70. The rails 66 are the same cross sectional configuration as the cross piece of the connector 62 in order to ensure that the finished rail has a neat and smoothly continuous appearance with no steps or shoulders.

Figure 22:
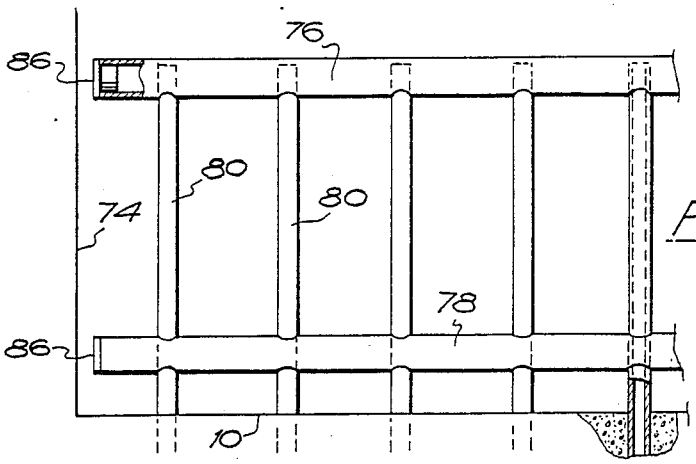
FIG. 22 is a view of a security railing according to another embodiment of the invention.

Yet a further railing arrangement according to another aspect of the invention is shown in FIG. 22. In this Figure the floor surface is indicated again by numeral 10, whilst an adjacent vertical surface defining the edge of an aperture or balcony is indicated by numeral 74. The railing system comprises upper and lower rails 76 and 78 and a plurality of vertical posts 80. Each of the rails 76 and 78 and each post 80 is suitably a plastics material extrusion, and the posts 80 pass through apertures in the lower rail 78, and engage in apertures in the underside of the rail 76 to give the configuration shown in FIG. 22, which Figure also shows that the lower ends of the vertical rails 80 are embedded in concrete of the floor 10.

Figure 23:
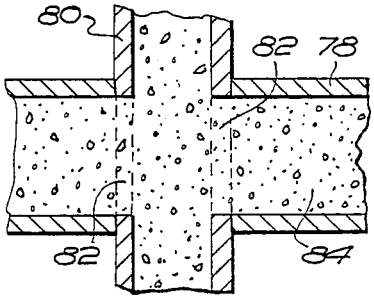
FIG. 23 is a sectional elevation of a junction between a rail and a post of the railing of FIG. 22.

The cross section of FIG. 23 also shows that the vertical rails 80 are provided with apertures 82 where they intersect the lower rails 78, so that there is formed a hollow and continuous interior inside the extruded tubular rails. This hollow area is filled with an expandable foam material such as polyurethane foam 84 in order to rigidify and strengthen the entire railing system, and end caps 86 prevents foam from escaping.

The foam may be injected into the interior of the rail on site or before it is delivered to site, and any suitable foaming resin may be used. Indeed, the concept of utilising foaming resin for rigidifying the interior of the railing system may be used on any of the embodiments hereinbefore described.

Although various size indications have been given for the inner and outer pipes because such plastics material pipes have yielded good load test results, it is to be mentioned that it may be possible to vary the sizes of the pipes.

Additionally, in some cases it may be possible to eliminate the need for the inner pipe in the posts of the railing system, the outer pipe being applied directly to the metal strengthening post, which metal strengthening post is used in all embodiments.

Figure 24:
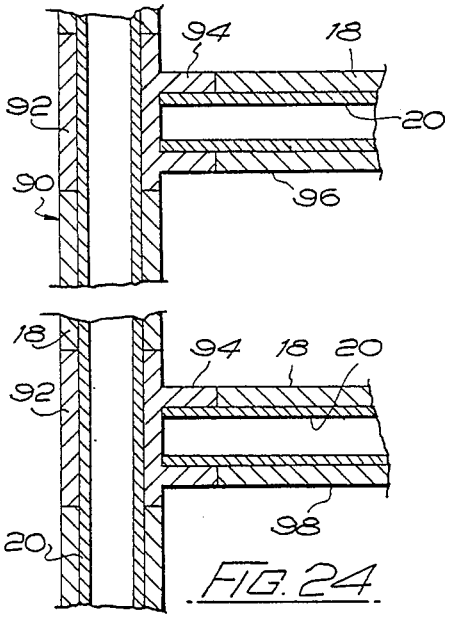
FIG. 24 is a sectional elevation showing how the principles of the present invention can be embodied to a swinging gate.

FIG. 24 shows how in another aspect of the invention, the laminated constructional post can be adapted for providing a swinging member such as a gate. In FIG. 24 a post 90 is shown in section, and will be seen to comprise an inner pipe 20 and an outer pipe 18 with two T connectors 92 rotatably mounted thereon. The connectors are provided with arms 94 receiving top rail 96 and bottom rail 98, each of laminated construction comprising an inner pipe 20 and an outer pipe 18 as described hereinbefore. As also described hereinbefore, the outer pipes 18 abut the connectors 92 and are of the same diameter as the connectors where they abut same in order to give the assembly a neat appearance. The inner pipes 20 of the rails 96 and 98 extend into bores in the connectors as shown, whilst in the case of the mounting of the connectors on the inner pipe 20 of the post 90, the said inner pipe passes through the connectors as shown but is not secured thereto. The connectors therefore form hinges, and the rails 96 and 98 can be connected so as to provide a gate structure, and the gate structure will be capable of swinging around the inner pipe 20.

I claim:

1. A security railing comprising:

a plurality of railing sections, each of said sections formed from an outer, plastics pipe having an outside dimension and an inner dimension and a second pipe, said second pipe having an inside dimension and an outside dimension essentially equal to the inside dimension of said first pipe, said second pipe inserted into said first pipe so that a portion of the second pipe projects beyond one end of the first pipe; a plurality of posts having upper and lower ends, each formed from one of said railing sections; a plurality of horizontal top rails, each formed from one of said railing sections;

T-shaped connector bodies between and connecting adjacent ones of said top rails and posts said connector bodies each having an inner bore essentially equal to the outside dimension of the second pipe and receiving said projecting portions of the second pipes of said connecting adjacent ones of said top rails and posts and an outside dimension essentially equal to the outside dimension of the outer pipe whereby the connector body forms smooth continuations of the outer pipes of said top rails and posts.

2. A security railing comprising:

a plurality of railing sections, each of said sections formed from an outer, plastics pipe having an outside dimension and an inner dimension and a second pipe, said second pipe having an inside dimension and an outside dimension essentially equal to the inside dimension of said first pipe, said second pipe inserted into said first pipe so that a portion of the second pipe projects beyond one end of the first pipe;

a plurality of posts having upper and lower ends, each formed from one of said railing sections; a plurality of horizontal top rails, each formed from one of said railing sections;

a connector body connecting adjacent ones of said top rails said connector body having an inner bore essentially equal to the outside dimension of the second pipe and receiving said projecting portion of the second pipes so that the projecting portion extends beyond the connector body and into the outer pipe of the adjacent top rail and an outside dimension essentially equal to the outside dimension of the outer pipe whereby the connector body forms a smooth continuation of the outer pipe.

3. The security railing defined in claim 1 or 2, which further comprises:

a plurality of metal rods vertically attached to a floor of a structure utilizing said security railing, said rods having a diameter to form a snug fit in said second pipe of each of said posts, whereby the installed security railing has each of said posts disposed over one of said rods.

4. The security railing as defined in claim 3 which further comprises:

said posts and said rods include a hole for a pin therethrough; and a pin inserted into said pinhole.

5. The security railing as defined in claim 1 or 2 in which:

said first pipe is formed from polyvinyl chloride plastic; and said second pipe is formed from polyvinyl chloride plastic.

6. The security railing according to claim 5, wherein at least one of the outer surface of the inner pipe and the inner surface of the outer pipe is provided with longitudinal serrations.

7. The security railing as defined in claim 1 or 2 in which said first and second pipes and said vertical rail members are round.

8. The security railing as defined in claim 1 or 2 in which said first and second pipes are rectangular.

9. The security railing as defined in claim 1 or 2 in which the outside surface of said top rails, said posts, and said bottom rails are decoratively patterned.

10. A security railing according to claim 1 or 2 wherein at least one of the outer surface of the inner pipe and the inner surface of the outer pipe of each rail or post is provided with longitudinal serrations of recesses receiving cement or glue connecting the pipes together.

11. A security railing comprising:

a plurality of railing sections, each of said sections formed from an outer, plastics pipe having an outside dimension and an inner dimension and a second pipe, said second pipe having an inside dimension and an outside dimension essentially equal to the inside dimension of said first pipe, said second pipe inserted into said first pipe so that a portion of the second pipe projects beyond one end of the first pipe;

a plurality of posts having upper and lower ends, each formed from one of said railing sections;

a plurality of horizontal top rails, each formed from one of said railing sections;

a connector body between said connecting adjacent ones of said top rails said connector body having an inner bore essentially equal to the outside dimension of the second pipe and receiving said projecting portion of the second pipe and an outside dimension essentially equal to the outside dimension of the outer pipe whereby the connector body forms a smooth continuation of the outer pipe, the railing further comprising lower rail cross connector bodies disposed near the lower end of each of said posts, said cross connectors cemented to said inner pipes and the outer pipe being in two sections abutting opposite sides of the connector;

a plurality of horizontal lower rails formed from said railing sections, one of said lower rails disposed between each adjacent pair of said posts, said lower rails connected to said post by said lower rail cross connectors by the inner pipes engaging therein and the outer pipes butting thereto, said lower rails cemented to said cross connectors;

a plurality of vertical rail members formed from plastics pipe having a dimension less than the inside dimension of said second pipe, said horizontal top rails having a plurality of first holes therein and said horizontal lower rails having a plurality of second holes therein forming pairs with said first holes, one of said vertical rail members inserted into each pair of first and second holes and further including wedge means engaged in at least one end of each vertical member and reacting against the inside of the rail in which it is located spreading the end of the member preventing it from being retracted from the rail.

12. A security railing according to claim 11, wherein the vertical members are tubes and the wedge means comprise wedges in the top (ends thereof) rails.

13. A security railing according to claim 12, wherein the wedges are forced into the top ends of the tubular vertical members to spread the top ends thereof by forcing the top rails downwards after the posts, lower rails and top rails have been placed in position.

14. A security railing according to claim 1 or 2, wherein each of said outer pipes and inner pipes is of extruded plastics material.

* * * * *